United States Patent [19]

Richardson

[11] 4,397,105

[45] Aug. 9, 1983

[54] KARATE SHOE

[76] Inventor: James M. Richardson, 6212 Canobie St., Whittier, Calif. 90601

[21] Appl. No.: 314,367

[22] Filed: Oct. 23, 1981

[51] Int. Cl.[3] ..... A43B 5/00

[52] U.S. Cl. ..... 36/106; 36/114

[58] Field of Search ..... 36/106, 114, 115, 2 R, 36/50, 72 R, 89

[56] References Cited

U.S. PATENT DOCUMENTS 4,008,531 2/1977 Schonbrun et al. ..... 36/106

4,103,437 8/1978 Dillard ..... 36/106

FOREIGN PATENT DOCUMENTS 2854954 6/1980 Fed. Rep. of Germany ..... 36/106

*Primary Examiner*—Patrick D. Lawson

*Attorney, Agent, or Firm*—Edgar W. Averill, Jr.

[57] ABSTRACT

A protective shoe for use during the practice of the art of karate and other sports. The shoe has a foot surrounding member shaped to surround a portion of the wearer's foot. The foot surrounding member is adapted to hold a shoe member shaped to surround the upper part of the foot. The shoe member is fabricated from a shock absorbing material.

11 Claims, 2 Drawing Figures

KARATE SHOE

BACKGROUND OF THE DISCLOSURE

The field of the invention is sportswear and the invention relates more particularly to equipment used in the martial arts including karate. Protective shoes for use in karate are preferably open at the bottom so that the user will have a maximum amount of contact between his foot and the floor. The upper part of the shoe is made from a foam material or other shock absorbing substance. The shoe not only protects the wearer's feet from bruising but also reduces the possibility of injury to the other participant.

One widely used protective shoe is disclosed in U.S. Pat. No. 3,769,722 wherein the shoe is held to the wearer's foot by one or more straps which surround the foot and shoe. While such shoe is generally satisfactory, it has the disadvantage of occasionally causing injury when one or more of these straps comes loose. Another such shoe is shown in U.S. Pat. No. 3,949,493 which has several cross members along the bottom of the shoe. This decreases the contact between the wearer's foot and the floor.

SUMMARY OF THE INVENTION

It is thus an object of the present invention to provide a better protective shoe for use during the practice of the art of karate and other sports.

The present invention is for a protective shoe useful for covering the upper part of the foot and surrounding the ankle with a protective pad. The protective shoe has a foot surrounding member shaped to surround a portion of the wearer's foot. The foot surrounding member has holding means affixed to the portion of the member which is positionable to the upper part of the foot but is open at the bottom. Preferably, the shoe member has an opening along the front part of that portion which surrounds the ankle and has a strap which can hold the opening in a closed configuration. Preferably, the foot surrounding member also surrounds the ankle and provides a separate ankle support member. In a still further preferred embodiment, the shoe member has a tongue which is also held to the shoe by the strap.

DESCRIPTION OF THE PREFERRED EMBODIMENTS

Figure 2:
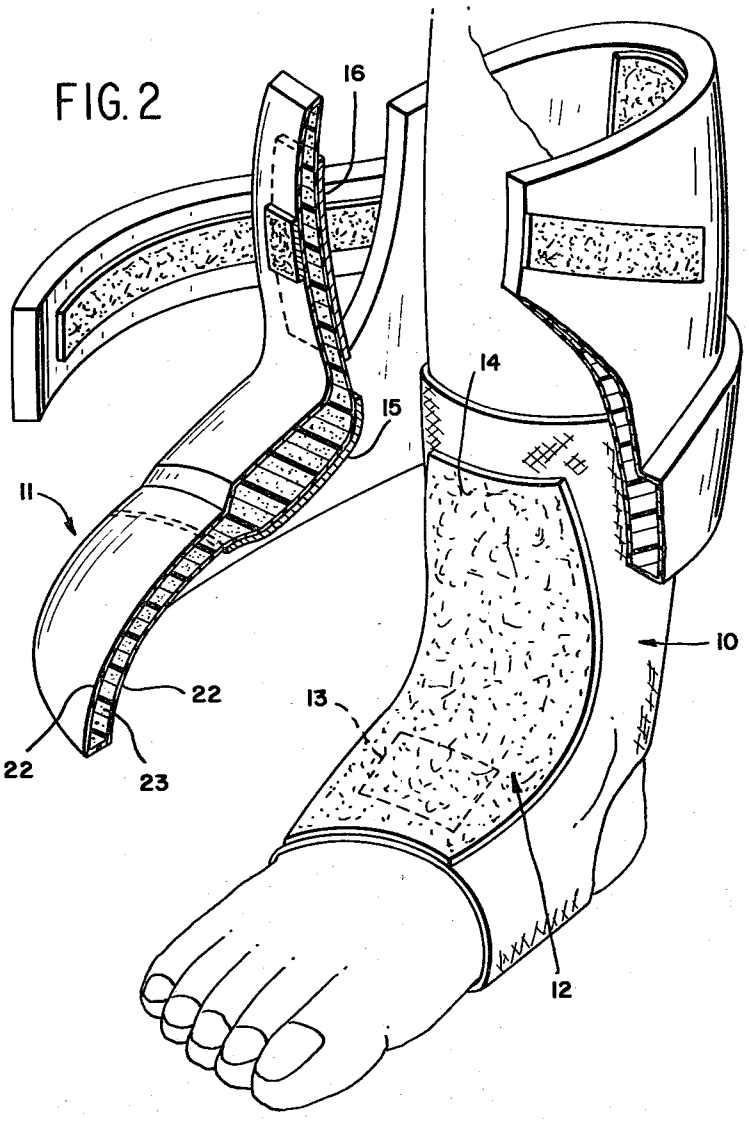
FIG. 2 is an exploded perspective view of the shoe of the present invention partially cut away.
Figure 1:
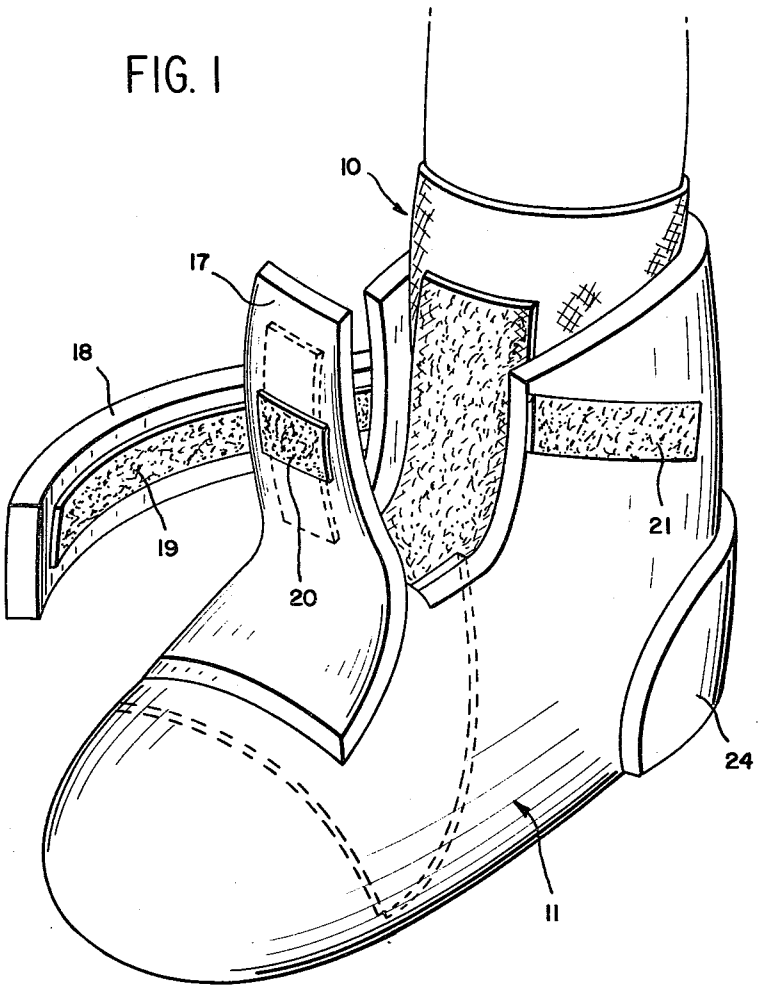
FIG. 1 is a perspective view of the perspective shoe of the present invention partially held to the foot surrounding member of the present invention.

The protective shoe of the present invention has two parts, namely a foot surrounding member indicated generally by reference character 10, and a shoe member indicated by 11. The foot surrounding member 10 also surrounds the ankle and is also referred to herein as an ankle support member. The ankle support member shown in FIGS. 1 and 2 is an elastic ankle support member which provides support to the ankle and foot and is particularly useful in the event that the wearer has a minor ankle sprain in that the support member is the type widely used for ankle support. Other foot surrounding members may alternatively be used such as those laced in the front and it is generally only important that the foot surrounding member be securely held to the foot to provide a method of holding the shoe member to the foot. An area of hook-and-eye material of the type commonly sold under the trademark "Velcro" is sewn or otherwise affixed to the ankle support member and indicated by reference character 12. Holding means 12 should be positioned at least along the top of the foot in the area indicated by dotted line 13. It is also beneficial to have holding means at area 14. Such holding means may additionally be positioned along back of the ankle (not shown) although this is less important than area 13.

In use, the ankle support member 10 with its holding means attached is placed on the foot and ankle and the shoe member 11 is placed over it as shown in FIG. 2. The shoe is then moved downwardly so that holding means 15 contacts holding means 12 to form a secure grip. The hook-and-eye material sold under the trademark "Velcro" is a particularly useful material for this use. The shoe in the drawings has a tongue member 17 which has an area of the holding means 16 affixed to the inner surface thereof. A strap 18 is attached to one side of the shoe and has a strip of holding material 19 which is positioned to contact an area of holding material 20 on the outer surface of the tongue and an area of holding material 21 on the side of the ankle.

Thus, after contacting holding means 15 with holding means 12, the tongue 17 is then pushed backward so that holding means 16 also contacts holding means 12. Then strap 18 is first moved in contact with holding area 20 and then 21 to securely close the tongue against the ankle. An area of "Velcro" 25 is also preferably secured to the inner back of the shoe and on the back of the ankle support member.

Preferably shoe member 11 is fabricated from a polymeric foam such as foam rubber and a closed cell foam sold under the trademark "Insulite" having a thickness of ½ inches has been found particularly useful. The life of the shoe is lengthened by coating the foam with a polymeric layer such as a vinyl plastisol layer indicated by reference character 22 in the drawings. The foam 23 is shown in cross-sectional view in the drawings. An additional padding area 24 is preferably located along the back of the heel area of shoe member 11.

The protective shoe of the present invention is particularly useful in that the ankle member provides support for the user's foot as well as leaving the front part of the foot open for contact with the floor. The heel is also left open for contact with the floor and only the arch and middle portion of the foot is covered and this covering is with a relatively thin layer having a minimal effect on traction. It is also within the purview of the present invention to provide a non-skid surface on the bottom portion of ankle support member 10. The use of a holding means such as "Velcro" on the strap and tongue also help secure the tongue in the desired position in spite of the strain placed upon the shoe by use.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A protective shoe for use during the practice of the art of karate and other sports where it is useful to cover the upper part of the foot and ankle with a protective pad said shoe comprising:

a foot surrounding member shaped to surround a portion of the wearer's foot, said shoe surrounding member having holding means affixed to the portion of the member which is positionable on the upper part of the wearer's foot; and a shoe member fabricated from a shock absorbing material said shoe member shaped to surround the ankle and cover the upper part of the foot but being open at the bottom, said shoe member also having holding means positioned at those places which correspond to the location of the holding means on the foot surrounding member.

2. The protective shoe of claim 1 wherein the foot surrounding member also surrounds the wearer's ankle.

3. The protective shoe of claim 1 wherein the shoe member has an opening along the front part of that portion which surrounds the ankle and further has a strap which passes over the opening along the front part which strap has means to hold the opening in a closed configuration.

4. The protective shoe of claim 3 further including a tongue member affixed to the shoe member at a point below the bottom of the opening along the front part and shaped to cover said opening.

5. The protective shoe of claim 1 wherein the holding means comprises hook and eye material.

6. The protective shoe of claim 1 wherein the shock absorbing material is a polymeric foam.

7. The protective shoe of claim 6 wherein the polymeric foam is coated with a flexible plastic material.

8. The protective shoe of claim 4 further including holding means positioned on a portion of the outer surface of the tongue member and on the inner surface of the corresponding portion of the strap.

9. The protective shoe of claim 4 wherein the tongue member and strap are fabricated from a shock absorbing material.

10. The protective shoe of claim 2 wherein the ankle support member is an elastic ankle support member.

11. The protective shoe of claim 1 further including an additional layer of shock absorbing material positioned over that portion of the shoe member which is positioned over the heel of the wearer.

* * * * *